United States Patent [19]

Ekstedt et al.

[11] Patent Number: 5,020,329

[45] Date of Patent: Jun. 4, 1991

[54] FUEL DELIVERY SYSTEM

[75] Inventors: Edward E. Ekstedt, Montgomery; Jack R. Taylor, Cincinnati, both of Ohio

[73] Assignee: General Electric Company, Cincinnati, Ohio

[21] Appl. No.: 251,989

[22] Filed: Sep. 29, 1988

Related U.S. Application Data

[63] Continuation of Ser. No. 18,723, Feb. 24, 1987, which is a continuation of Ser. No. 684,434, Dec. 20, 1984, abandoned.

[51] Int. Cl.[5] ..... F02C 7/22

[52] U.S. Cl. ..... 60/737; 60/743; 60/39.32

[58] Field of Search ..... 60/748, 737, 740, 39.31, 60/39.32, 743; 239/469, 470

[56] References Cited

U.S. PATENT DOCUMENTS

| | | | |
|---|---|---|---|
| 3,116,606 | 1/1964 | Dougherty et al. | 60/39.31 |
| 3,483,699 | 12/1969 | Harvey et al. | 60/737 |
| 3,713,588 | 1/1978 | Sharpe | 239/400 |
| 3,724,207 | 4/1973 | Johnson | 60/743 |
| 3,811,278 | 5/1974 | Taylor et al. | 60/39.74 |
| 3,912,164 | 10/1975 | Lefebvre et al. | 239/5 |
| 3,915,387 | 10/1975 | Carvel et al. | 60/748 |
| 3,927,835 | 12/1975 | Gerrard | 60/748 |
| 3,980,233 | 9/1976 | Simmons et al. | 60/748 |
| 4,092,826 | 6/1978 | Pask | 60/39.74 |
| 4,311,278 | 1/1982 | Sutton | 432/58 |
| 4,321,794 | 3/1982 | Etheridge | 60/743 |
| 4,373,325 | 2/1983 | Shekleton et al. | 60/39.06 |
| 4,407,128 | 10/1983 | Kwan | 60/737 |
| 4,409,791 | 10/1983 | Jourdain et al. | 60/39.32 |
| 4,453,384 | 6/1984 | Pask | 60/748 |

FOREIGN PATENT DOCUMENTS

| | | | |
|---|---|---|---|
| 1245741 | 10/1960 | France | 239/469 |
| 657789 | 9/1951 | United Kingdom . | |
| 684669 | 12/1952 | United Kingdom . | |
| 1031184 | 6/1966 | United Kingdom . | |
| 1429589 | 3/1976 | United Kingdom . | |
| 1563125 | 3/1980 | United Kingdom . | |
| 2050592 | 1/1981 | United Kingdom . | |

*Primary Examiner*—Louis J. Casaregola
*Assistant Examiner*—Timothy S. Thorpe
*Attorney, Agent, or Firm*—Jerome C. Squillaro

[57] ABSTRACT

An improved fuel delivery system for the combustor of a gas turbine engine is disclosed. The improvement comprises a combustor support pin, a fuel atomizer, and a tube for delivering fuel to the atomizer. The combustor support pin provides axial support for the combustor and includes a duct therethrough. The fuel delivery tube is removably located within the duct.

3 Claims, 1 Drawing Sheet

FUEL DELIVERY SYSTEM

This is a continuation of application Ser. No. 018,723, filed Feb. 24, 1987 which is a continuation of application Ser. No. 684,434, filed on Dec. 20, 1984, both now abandoned.

This invention relates generally to gas turbine engines and, more particularly, to fuel injectors and swirl cups for combustors therein.

BACKGROUND OF THE INVENTION

Gas turbine engines include a combustor where fuel and air are burned in order to produce a high energy gas stream. The apparatus and method by which fuel is delivered into the combustion chamber plays an important role in determining combustor performance. Successful combustion depends upon consistance fine droplet atomization of the fuel.

Two primary methods of atomizing fuel are in current use. The first involves a pressure atomizer in which fuel is forced under pressure through a small orifice from which it emerges as a multitude of high velocity atomized fuel droplets. A second method is by use of an air blast atomizer in which liquid fuel is shattered into droplets by the force of high velocity air.

Both pressure atomizers and air blast atomizers include a fuel injector as well as means for introducing and mixing air with the fuel. Typical of the latter is a swirl cup or swirler which is designed to admit air into the combustor as well as ensure thorough mixing with the injected fuel.

Normally, the swirler is rigidly attached to the combustor with the fuel injector being removably connected to the swirler. This is necessary so that the fuel tube may be removed from the combustor for periodic inspection. Furthermore, temperature swings in the combustor result in thermally induced motion of the combustor and swirl cup. Such motion necessitates a sliding fitting between the fuel injector and the swirler. Such fittings may be objects to large forces which may result in undue wear. As a consequence, these fittings are costly to fabricate and repair and represent a significant portion of the combustion system weight.

OBJECTS OF THE INVENTION

It is an object of the present invention to provide a new and improved fuel delivery system.

It is another object of the present invention to provide a new and improved fuel injector.

It is a further object of the present invention to provide a new and improved air blast atomizer.

It is yet another object of the present invention to provide a fuel delivery system with a lightweight and easily removable fuel injector.

SUMMARY OF THE INVENTION

The improved fuel delivery system according to the present invention comprises a combustor support pin, a fuel atomizer, and a tube for delivering fuel to the atomizer. The combustor support pin provides axial support for the combustor and includes a duct therethrough. The fuel delivery tube is removably located within the duct.

According to a further embodiment of the present invention, the fuel atomizer includes outer, middle, and inner coaxial air passages. The outer and inner passages have vanes for producing counterrotational swirl for air passing therethrough. The fuel delivery tube delivers fuel to the middle passage. The middle passage includes vanes for swirling air passing therethrough thereby forming a fuel film.

DETAILED DESCRIPTION OF THE DRAWINGS

Figure 1:
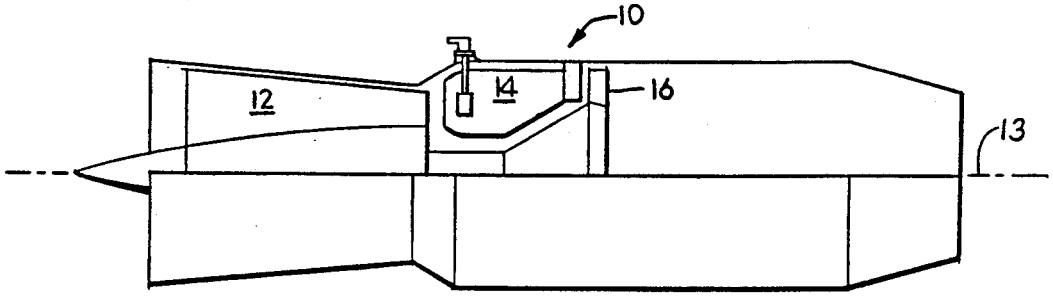
FIG. 1 is a schematic view of a gas turbine engine including a combustor which embodies the present invention.

FIG. 1 shows a gas turbine engine 10 including a compressor 12, a combustor 14, and a turbine 16 disposed coaxially along a centerline 13 and in serial flow relationship. Air flowing aft through engine 10 is compressed by compressor 12 and then mixed with fuel in combustor 14 and ignited to form a high energy gas stream. Part of the energy of this exhaust stream is extracted by turbine 16 which drives the compressor. Included in FIG. 1 is a fuel delivery system 18 located radially outwardly from centerline 13.

Figure 2:
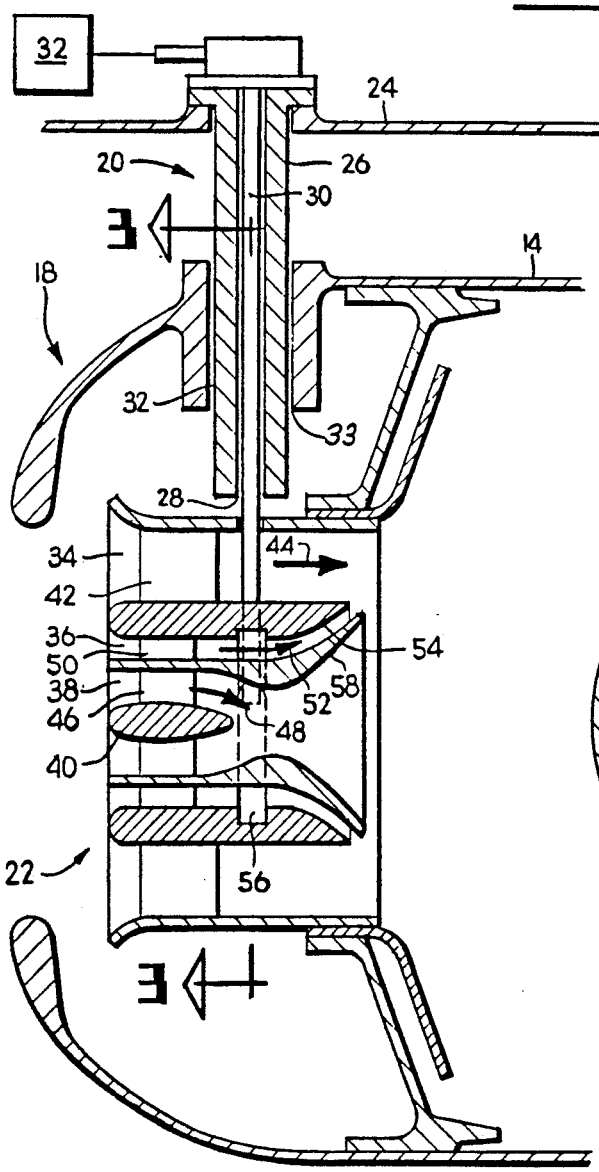
FIG. 2 is a view of a fuel delivery system according to one form of the present invention.

FIG. 2 shows a detailed view of a fuel delivery system 18 for delivering a fuel air mixture to combustor 14. The major components of this system includes a fuel injector 20 and a fuel atomizer 22. Combustor 14 is supported to an outher casing 24 by a plurality of combustor support pins 26. Each support pin is located on the forward end of combustor 14 and generally radially offset from fuel atomizer 22. In a preferred embodiment, each support pin 26 is generally radially directed and provides axial support for combustor 14. A feature of support pin 26 is a duct 28 which passes therethrough.

A fuel tube 30 for delivering fuel from a source 32 to atomizer 22 is removably located within duct 28. In a preferred embodiment, fuel tube 30 will be generally linear within pin 26 and between pin 26 and atomizer 22. The positioning of combustor support pin 26 in generally the same radial plane as fuel atomizer 22 results in little axial movement of combustor 14 relative to outer casing 24 in that vicinity. Furthermore, any thermally induced radial growth of combustor 14 will be relieved by sliding joint 33 between combustor 14 and combustor support pin 26. Thus, there should be no excessive forces acting on fuel tube 30.

Fuel atomizer 22 includes an outer air passage 34, a middle air passage 36, and an inner air passage 38. Passages 34, 36, and 38 are coaxial and disposed outwardly from a centerbody 40. Outer air passage 34 includes a plurality of vanes 42 for swirling air 44 passing therethrough. Inner air passage 38 includes a plurality of vanes 46 for swirling air 48 therethrough. Vanes 42 and 46 are of opposite orientation, thereby swirling air 44 and 48 in counterrotating directions. Middle air passage 36 includes a plurality of vanes 50 for swirling air 52 passing therethrough.

Figure 3:
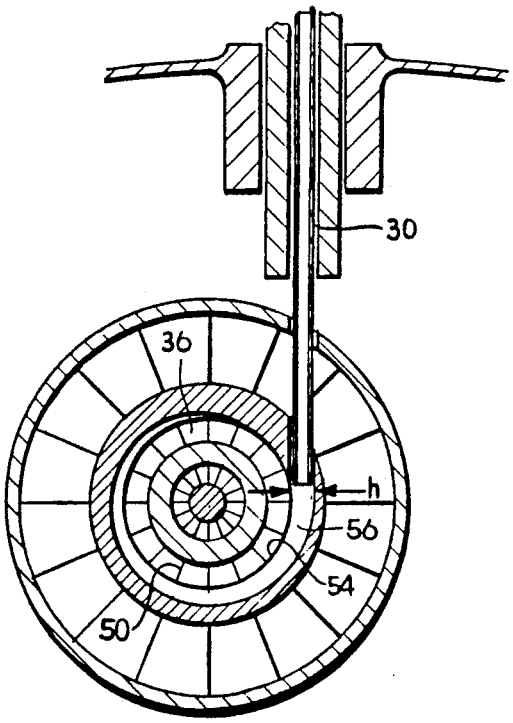
FIG. 3 is a view taken along the lines 3—3 in FIG. 2.

As shown in FIGS. 2 and 3, middle air passage 36 has a generally annular cross-section. Passage 36 has an outer wall 54 with a shrinking groove 56 circumferentially disposed therein. What is meant by a "shrinking groove" is a groove which starts at a given height h and gradually reduces to zero in its circumferential path around air passage 36. Groove 56 receives an end of fuel tube 50. In this manner, fuel delivered by tube 30 will enter groove 56 from which it will pass into middle passage 36. Air 52 contacting fuel entering passage 36 will produce a fuel film along outer wall 54.

Inner passage 38 has a diverging opening 58 located downstream of the airflow entering inner passage 38. Air 48 exiting therefrom cooperates with air 44 exiting outer air passage 34 to blast atomize the fuel film exiting middle passage 36.

Tube 30 is tangential to groove 56 so that fuel delivered by tube 30 will be swirled in a circumferential direction. Depending upon the orientation of vanes 50, the swirl imparted by air passing through vanes 50 may either augment the initial swirl or be counterrotational thereto. Either orientation may be employed to provide a satisfactory fuel film on outer wall 54. In addition, the circumferential distribution of the fuel film can be further controlled by the geometry of shrinking groove 56.

In operation, fuel is delivered from source 32 through fuel tube 30 into shrinking groove 56 and from there into passage 36. In the manner described above, a fuel film is formed on outer wall 54 which is blast atomized by air 44 and 48 exiting outer air passage 34 and inner air passage 38, respectively. The fuel air mixture thus formed will be ignited by an igniter (not shown) to form a high energy gas stream.

The heat of the combustion process will cause differential movement of combustor 14 with respect to outer casing 24. Combustor support pin 26 is located near fuel atomizer 22 so that relatively little axial motion is transmitted thereto. Each fuel tube 30, located within a combustor support pin 26, is easily removable therefrom and requires no special fitting to connect it to atomizer 22. Both fuel tube 30 and shrinking groove 56 are relatively large thereby being less likely to clog or be subject to carbon deposits.

Another significant feature of the present invention is that a single opening in outer casing 24 serves both combustor support pin 26 as well as fuel tube 30. This reduces the number of openings otherwise required in outer casing 24 thereby improving the overall strength of the system. Furthermore, by having fuel tube 30 within combustor support pin 26, both mechanical and thermal shielding of tube 30 is achieved.

It will be clear to those skilled in the art that the present invention is not limited to the specific ebodiment described and illustrated herein. Nor is the fuel injector of the present invention limited to the fuel atomizer shown herein. Rather, the fuel injector may be used to deliver fuel to alternatively configured atomizers.

It will be understood that the dimensions and the proportional and structural relationships shown in the drawings are illustrated by way of example only, and these illustrations are not to be taken as the actual dimensions or proportional structural relationships used in the fuel delivery system of the present invention.

Numerous modifications, variations, and full and partial equivalents can now be undertaken without departing from the invention as limited only by the spirit and scope of the appended claims.

What is desired to be secured by Letters Patent of the United States is the following.

What is claimed is:

1. A gas turbine engine fuel delivery system generally disposed within an annular engine casing comprising:

a combustor disposed within the casing and connected to the casing by at least one combustor support pin disposed in a sliding joint in said said combustor for providing axial support for said combustor with respect to the annular engine casing, said pin including a duct therethrough;

a fuel atomizer disposed within said combustor;

a tube for delivering fuel to said atomizer, said tube being removably located within said duct; and wherein said atomizer includes an annular air passage defined by an annular outer wall with an inner surface and a fuel passage therethrough, a radially, with respect to said annular outer wall, tapered groove having a deep end and a shallow end and formed in and in part defined by said outer annular wall and circumferentially disposed upon said inner surface wherein said fuel passage connects said tube to said deep end of said groove.

2. A gas turbine engine fuel delivery system, as recited in claim 6, wherein said tube is tangential to said circumferentially disposed radially tapered groove.

3. A gas turbine engine fuel delivery system,, as recited in claim 1, wherein said atomizer is fixedly connected to said combustor.

* * * * *